United States Patent [19]

Matre

[11] Patent Number: 5,069,142

[45] Date of Patent: Dec. 3, 1991

[54] COLLAPSIBLE TABLE

[76] Inventor: Vigbjørn Matre, Omerudveien 59A, N-1410 Kolbotn, Norway

[21] Appl. No.: 651,218

[22] PCT Filed: Jul. 26, 1989

[86] PCT No.: PCT/NO89/00077

§ 371 Date: Feb. 13, 1991

§ 102(e) Date: Feb. 13, 1991

[87] PCT Pub. No.: WO90/00868

PCT Pub. Date: Feb. 8, 1990

[30] Foreign Application Priority Data

Jul. 27, 1988 [NO] Norway ..... 883318

[51] Int. Cl.[5] ..... A47B 23/00

[52] U.S. Cl. ..... 108/42; 108/33; 108/115

[58] Field of Search ..... 108/42, 48, 33, 34, 108/35, 38, 39, 138

[56] References Cited

U.S. PATENT DOCUMENTS

| | | | |
|---|---|---|---|
| 736,886 | 8/1903 | Smith | 108/138 |
| 928,726 | 7/1909 | Witthaus | 108/42 |
| 2,388,192 | 10/1945 | Stechbart | 108/33 X |
| 2,719,066 | 9/1955 | Budzinski | 108/33 |
| 3,000,683 | 9/1961 | MacNeary | 108/33 X |
| 3,105,488 | 10/1963 | Patrie | 108/42 |
| 3,203,373 | 8/1965 | King | 108/20 |

FOREIGN PATENT DOCUMENTS

| | | | |
|---|---|---|---|
| 1320941 | 2/1963 | France | 108/115 |
| 15639 | 12/1909 | United Kingdom | 108/42 |
| 833931 | 5/1960 | United Kingdom | 108/115 |

*Primary Examiner*—Peter A. Aschenbrenner
*Attorney, Agent, or Firm*—Sughrue, Mion, Zinn, Macpeak and Seas

[57] ABSTRACT

A collapsible table comprising a table top, a base member and a number of supporting legs which at one end are pivotally connected to the table top and at its other end are pivotally connected to the base member. The base member is a box-like member which is arranged to be placed in a corresponding opening in the floor on the place of use of the table. The base member comprises transversely extending shafts with which respective lower ends of the legs are connected through lateral parts. In connection with the shafts there are preferably provided supporting members which are arranged to support a plate-shaped floor element for covering of the floor opening, so that the floor element in the collapsed position of the table is located between the legs and the supporting members, and in the erected position of the table is raised to a level flush with the floor surface around the floor opening by means of the supporting members.

10 Claims, 6 Drawing Sheets

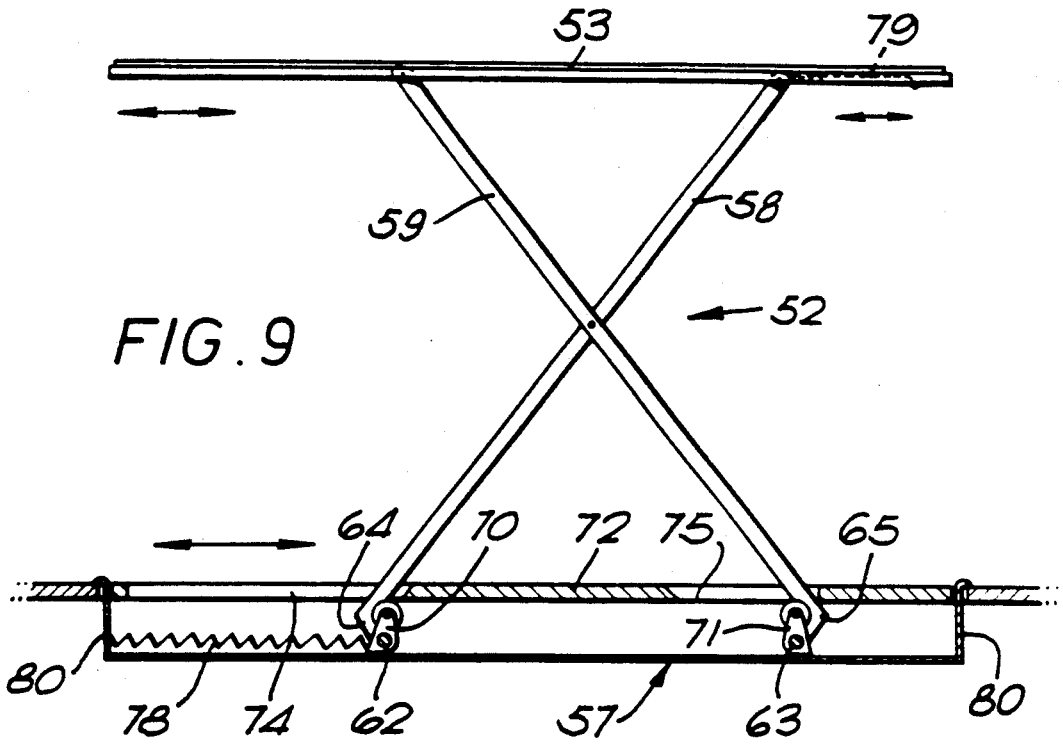
FIG. 9
FIG. 10
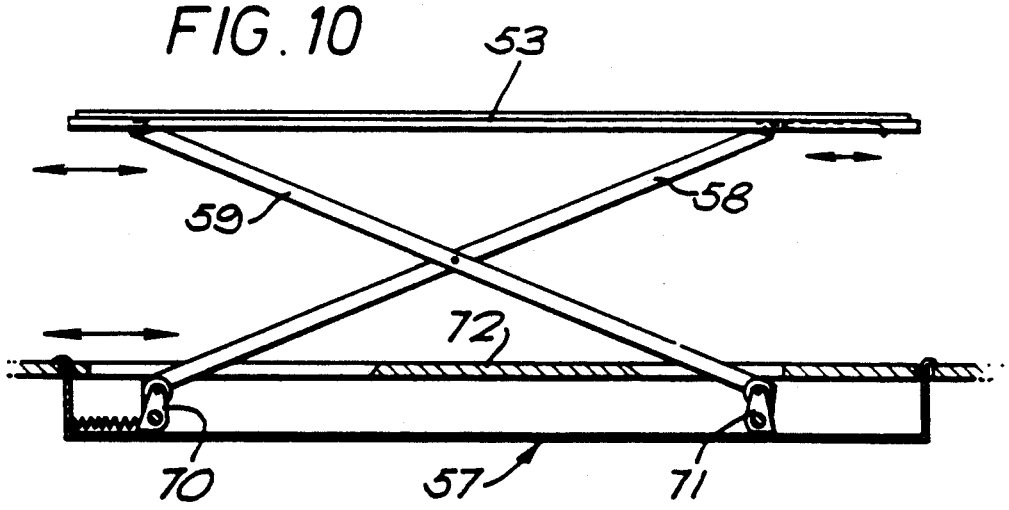
FIG. 11
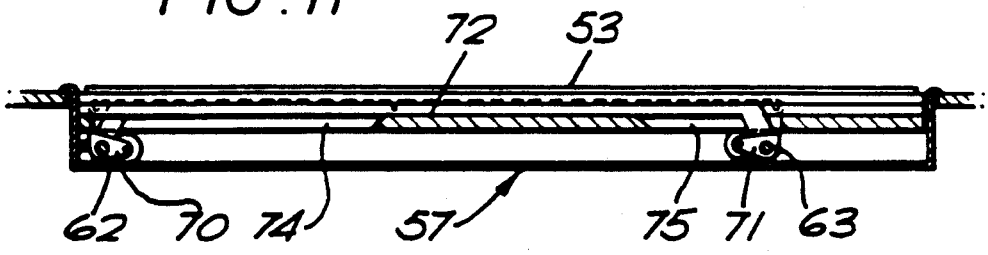

COLLAPSIBLE TABLE

The present invention relates to a collapsible table comprising a table top, a base member and a number of supporting legs which at one end are pivotally connected to the able top and at the other end are pivotally connected to the base member.

A table of the above-mentioned type is known from U.S. Pat. No. 2,565,187. The patent specification shows a card table wherein the legs are in the form of an articulated, collapsible supporting structure which is hinged to a bottom member and a table top, respectively. The supporting structure is to give a sturdy support in extended condition, a special means being provided for locking and reinforcing the supporting structure in this condition, and simultaneously allowing easy folding and storage in a small space. However, the table is intended to stand freely on the supporting floor surface.

It is an object of the invention to provide a collapsible table which is particularly suitable for installation and use in camping cars, caravans, pleasure boats, commercial boats, railway carriages, driver's cabs of transport lorries, buses, etc., wherein the table can be folded to a position wherein the table top is flush with a floor surface at the place of use of the table, and wherein the table is fixed to the ground and stands stably in erected position of use.

The above-mentioned object is achieved with a table of the introductorily stated type which, according to the invention, is characterized in that the base member is an upwards open, essentially box-like member which is arranged for assembly in a corresponding opening in the floor at the place of use of the table, and that the lower ends of the legs are mounted at a bottom portion of the base member, the base member having side walls of such a height that the table top in the folded position of the table rests on the underlying legs with its upper surface flush with the level of the floor surface around the floor opening.

An advantageous embodiment of the table according to the invention is characterized in that the lower ends of the legs are mounted by means of transversely extending shafts and are connected to the shafts through transverse or lateral parts, and that supporting members are provided in connection with the shafts, which members are arranged to support a plate-shaped floor element for covering of said floor opening, so that the floor element in the folded position of the table is located between the legs and the supporting members, and in the erected position of the table by means of the supporting members is raised to said floor surface level. In that the top of the table in the folded position is flush with and thus forms a part of the floor surface, there is obtained a greater usable floor surface and that the table is removed and does not cause any disturbance when it is not in use. By means of said floor element there is further achieved that the recess in the floor is covered and concealed also when the table is in erected service position, something which, in addition to being aesthetically advantageous, also has practical advantages, i.a. in that loose objects can not fall into the recess, that one can not step into the recess, etc.

Further, it is advantageous that the side walls of the base member at its upper edge are arranged to form a sealing connection with the side edges of the table top when the table is in folded position. By means of such a sealing one achieves that the table top in folded condition of the table can be flushed with water, without this flowing into the floor opening. This may be a requirement, for example in use on board a boat. In addition, dirt is prevented from penetrating into the opening.

The table top preferably consists of a centre member and side flaps hinged thereto, which flaps can be turned in over the centre member and are designed such that the table top in folded condition can be lowered into the box-shaped base member and form said sealing connection. When the floor at the place of use is covered by a carpet or the like, a covering of the same type may be attached to the underside of the flaps, possibly only to one flap if this covers the whole of the other flap in the turned-in condition of the flaps, so that this covering faces upwards when the flaps are turned in, and then is flush with the remaining floor covering when the table is in the folded position. Such a covering may also be provided on the upper side of the floor element.

The invention will be further described below in connection with exemplary embodiments with reference to the accompanying drawings, wherein FIGS. 1A–1C show different designs of table tops in tables according to the invention;

Figure 8:
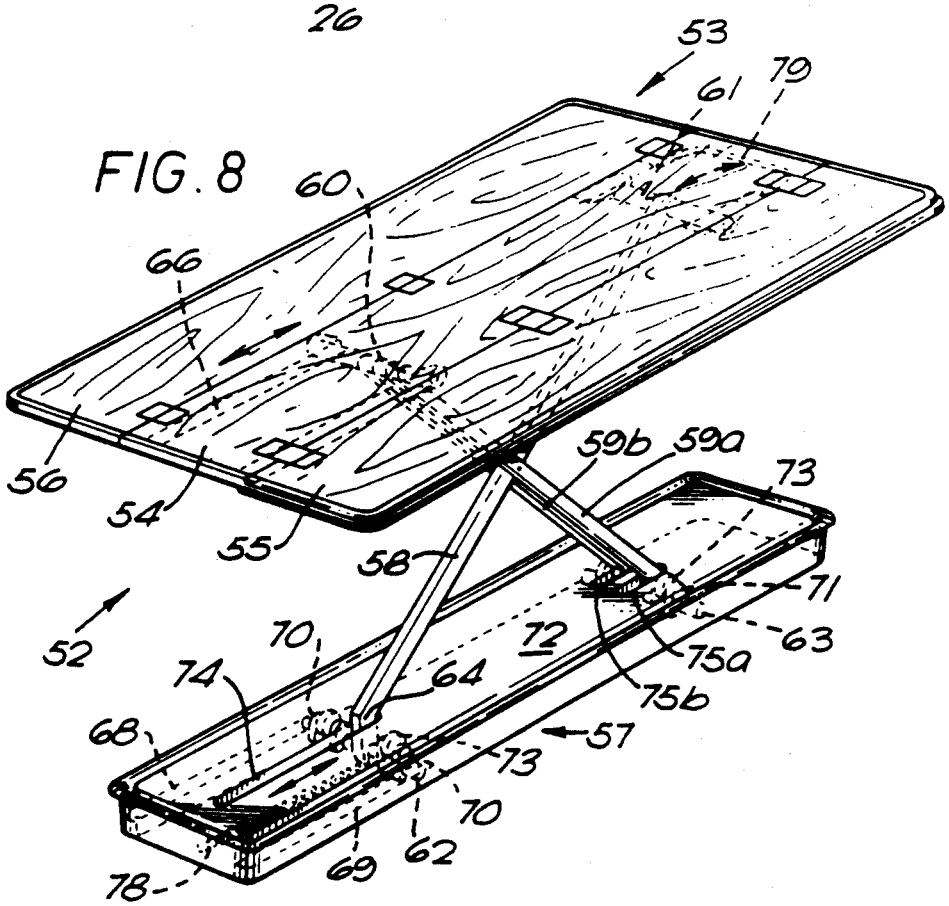
Figure 12A:
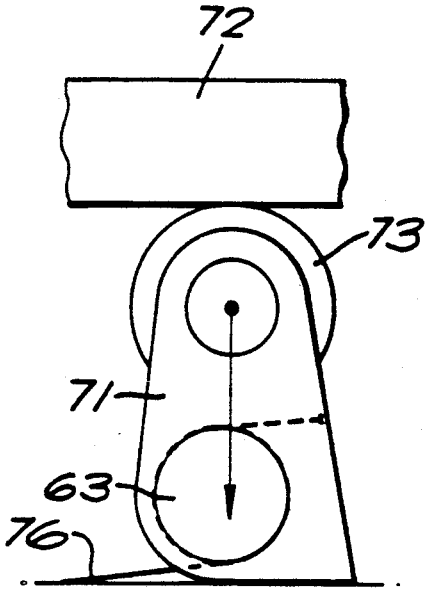
Figure 12B:
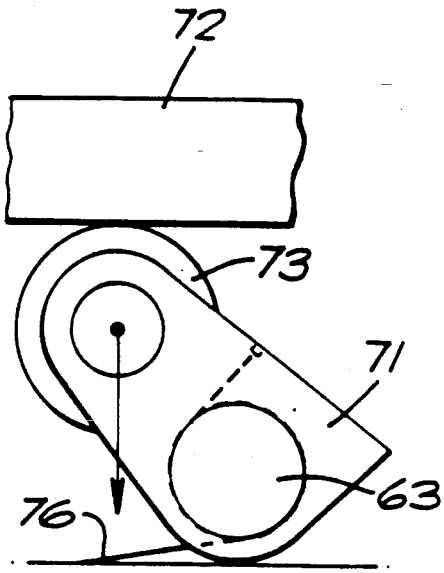
Figure 13:
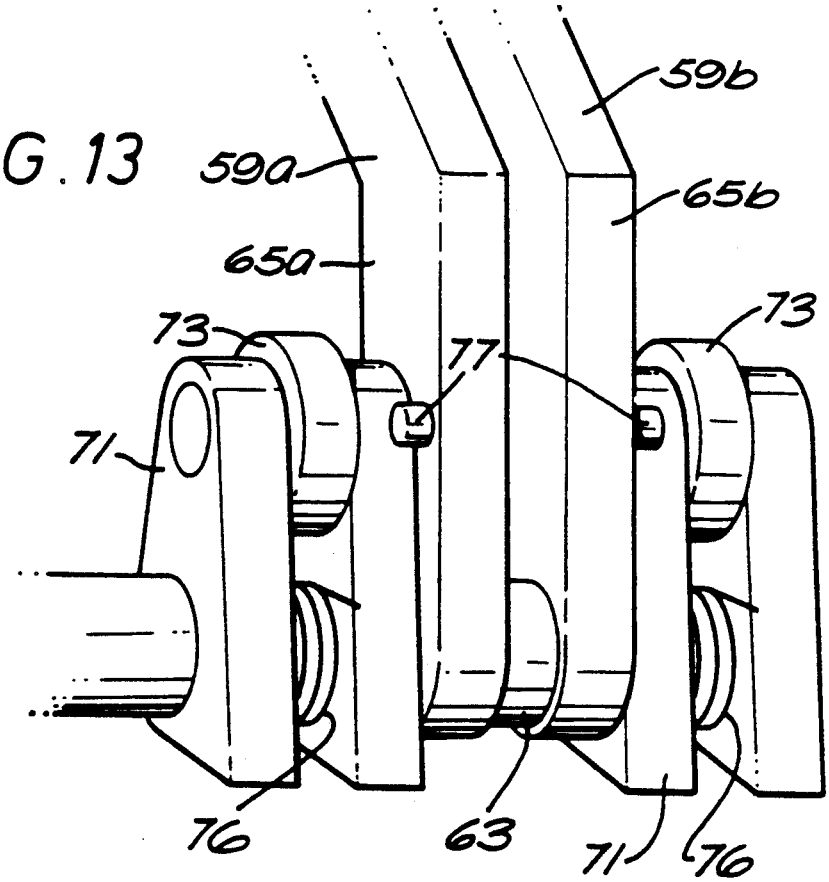

FIG. 8 schematically shows a perspective view similar to that of FIG. 1 of a second embodiment of a table according to the invention;

FIGS. 9–11 show partly sectioned, schematic side views of the table in FIG. 8 in erected position, an intermediate position and folded position, respectively;

FIGS. 12A and 12B show side views of a supporting member in the embodiment in FIG. 8, in erected position and in an intermediate postion, respectively; and FIG. 13 shows a perspective view of a supporting member arrangement in the embodiment in FIG. 8.

In the drawings, corresponding members and elements in the different Figures are designated by the same reference numerals.

Figure 1A:
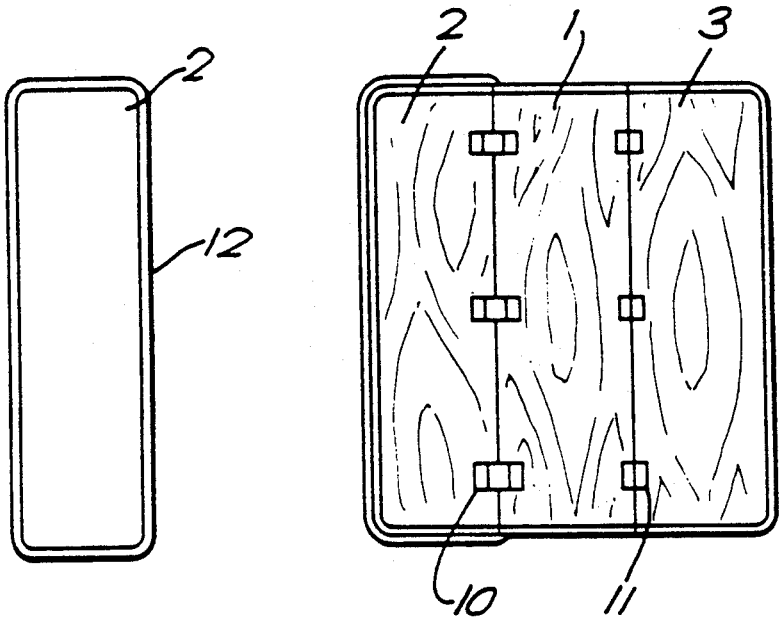
Figure 1B:
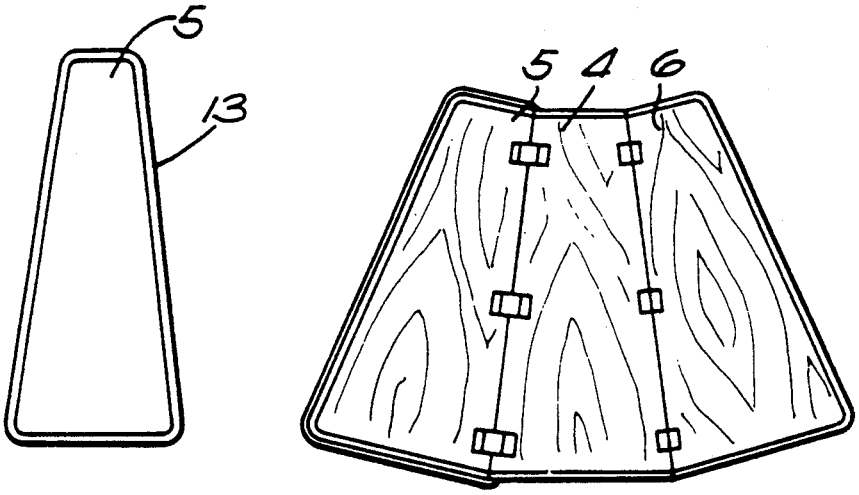
Figure 1C:
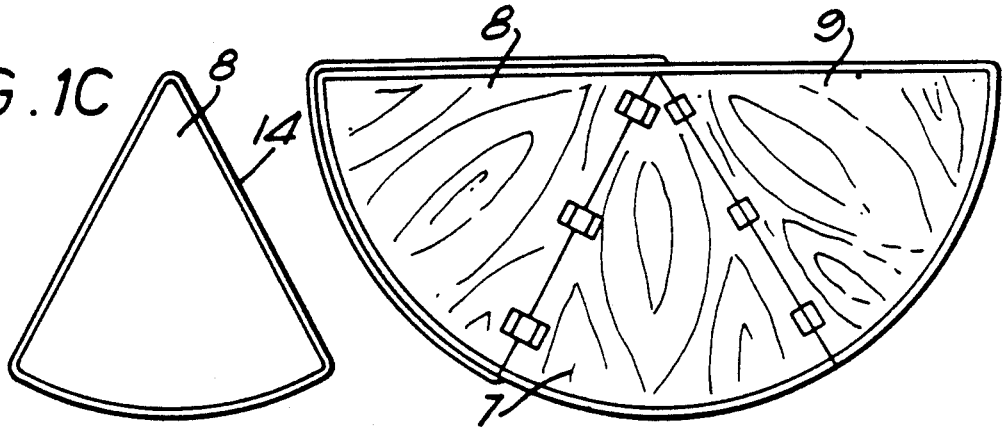

FIGS. 1A, 1B and 1C show various possible designs of the table top for hinged flap tables according to the invention. FIG. 1A shows a rectangular table top having a centre member 1 and a pair of flaps 2, 3; FIG. 1B shows a table top having a tapering centre member 4 and corresponding flaps 5, 6; and FIG. 1C shows a table top having a centre member 7 formed as a sector of a circle and corresponding flaps 8, 9. The centre member and the flaps are hinged to each other by a number of hinges 10 and 11. It will be appreciated that the flaps in the illustrated variants lay above and cover each other in their in-turned position. For this reason the hinges 10 for the overlying flap are "double", as shown in more detail in FIG. 5. Alternatively, the flaps might e.g. be half as large as the centre member, so that they together cover this in the in-turned condition. However, this will result in a larger width of the centre member, with the same total width of the table top.

As it will appear, the overlying flaps are provided with an encircling sealing profile which, in FIGS. 1A, B and C, is designated 12, 13 and 14, respectively. This sealing profile may have the form shown in more detail in FIGS. 5 and 7.

It will be appreciated that the shape of the table top generally can be adapted to the shape of the surroundings where the table is to be used, in order to increase the possible applications. The configuration shown in FIG. 1C for example may be adapted to e.g. the stem of a pleasure boat wherein the table is to be installed.

Figure 2:
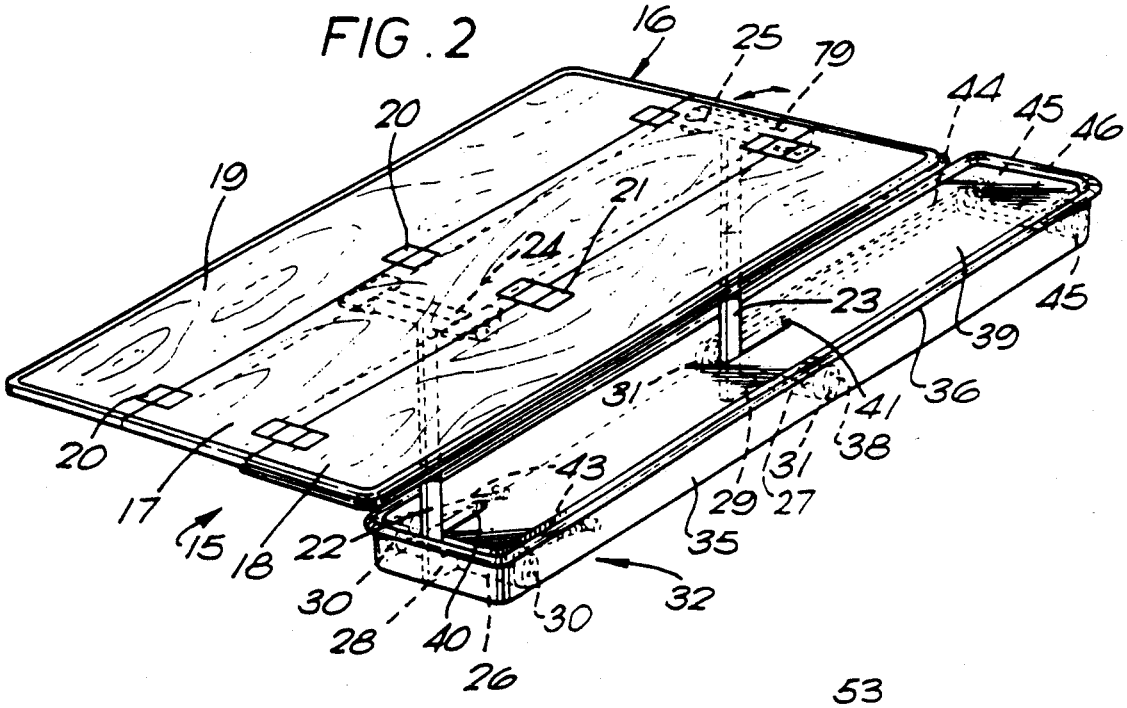
FIG. 2 shows a schematic perspective view of a first embodiment of a table according to the invention in erected position.
Figure 3:
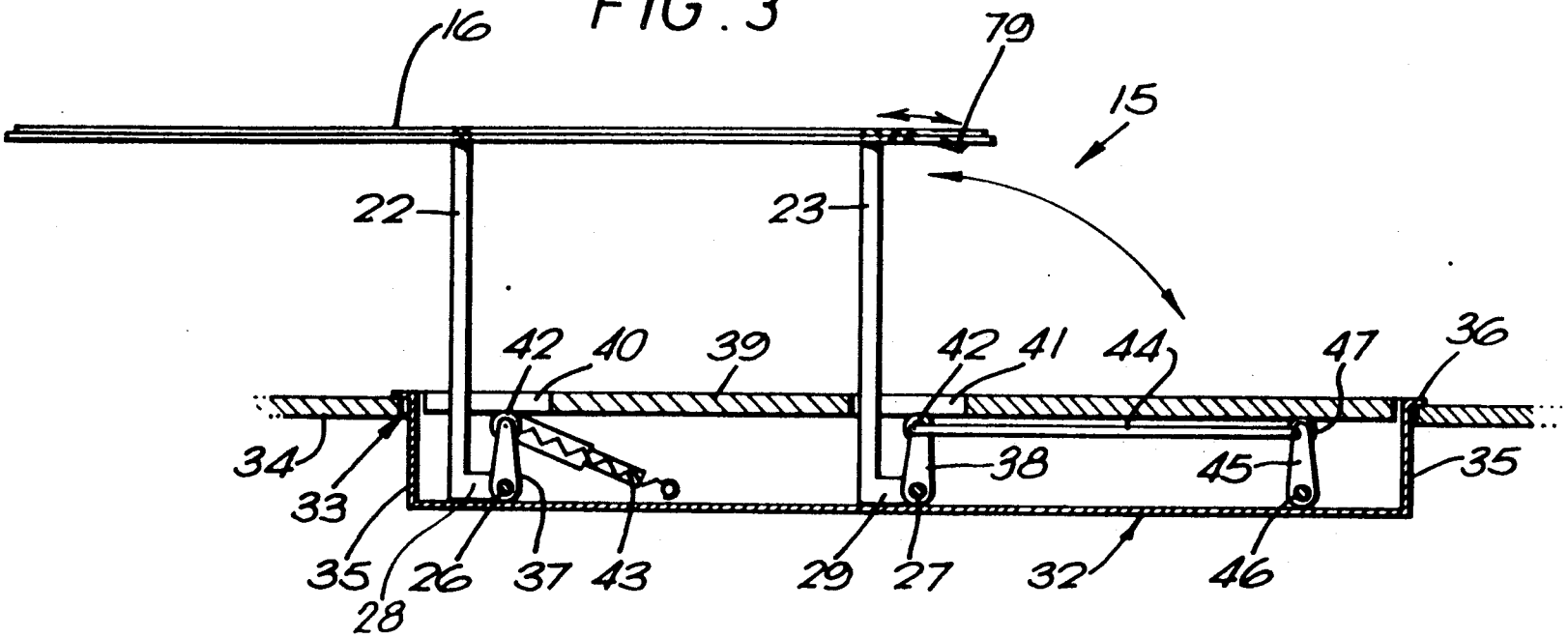
FIGS. 3 and 4 show partly sectioned, schematic side views of the table in FIG. 2 in erected and folded position, respectively.
Figure 4:
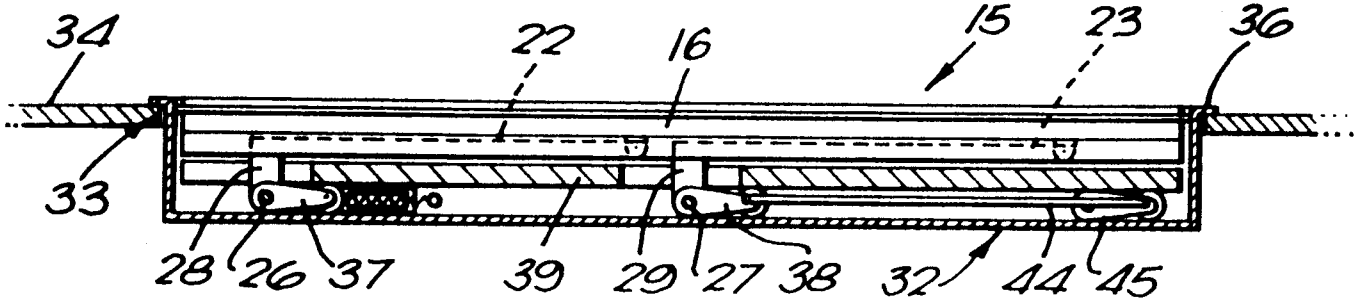

In the embodiment schematically shown in FIGS. 2–4, the table 15 comprises a table top 16 consisting of a centre member 17 and a pair of flaps 18, 19 hinged to the centre member by a number of hinges 20, 21. The legs of the table consist of a pair of supporting pillars or columns 22 and 23, respectively, which are placed centrally as shown in FIG. 2, i.e. at the longitudinal centre line of the table. Each column is at one end, i.e. the upper end in the erected position or service position of the table, rigidly connected to a transversely extending rod 24 and 25, respectively, which at each end is pivotally mounted on the underside of the table top. At its other or lower end each column 22 and 23, respectively, is rigidly connected to a transversely extending rotary shaft 26 and 27, respectively, through a transverse or lateral part 28 and 29, respectively, projecting from the column and together with this forming an L-shaped element. The rotary shafts are at each end mounted in suitable respective bearings or fulcrums 30, 31 assembled or arranged in the base member 32 of the table.

As shown, the base member 32 consists of a tray- or box-like member which is adapted for assembly in a recess or opening 33 in the floor 34 (see FIGS. 3 and 4) at the place of installation or use of the table. As shown, the base member has side walls 35 which, along their upper edge, have an outwards projecting flange 36 for abutment against the adjacent edge of the opening 33 when the table is installed. Along their upper edge, the side walls are also arranged to form a sealing connection with the side edges of the table top 16, and also with the floor element of the table, as further described in connection with FIGS. 5 and 6. For the sake of simplicity, the details of this sealing arrangement are left out in FIGS. 3 and 4.

Even if the base member in principle is formed as a box-like member, it will be appreciated that it may be a more or less open frame structure.

To each of the rotary shafts 26, 27, at each end thereof, there is rigidly connected a supporting member which, in the illustrated embodiment, is in the form of a carrying or supporting arm 37 and 38, respectively, projecting from the shaft in question essentially parallel with the supporting columns 22, 23. The supporting arms are arranged to support a plate-shaped floor element 39 covering the opening 33 in the floor 34. In the folded or collapsed position of the table (FIG. 4) the floor element 39 is located between the columns 22, 33 and the supporting arms 37, 38, the lateral parts 28, 29 providing for a suitable intermediate space between the columns and the supporting arms. As appears from FIG. 3, the lateral parts are shaped in such a manner that they rest stably against a bottom portion of the base member 32 when the table is in its erected position with the supporting columns in vertical position, so that the table stands stably in this position. In this position the floor element 39 is raised by means of the free end portions of the supporting arms to a level flush with the surface of the floor 34, the length of the supporting arms being adjusted to the depth of the base member 32.

For each supporting column 22 and 23, respectively, the floor element 39 is provided with a longitudinally extending slot 40 and 41, respectively, through which the column extends, and which has a sufficient length and width to allow the column and its lateral part 28 and 29, respectively, to pass during erecting and folding of the table.

In the illustrated embodiment, each of the supporting arms 37, 38 is provided at its free end with a roller 42, e.g. of rubber, for rolling support of the floor element 39 during raising and lowering thereof.

As shown, there are also provided a pair of spring means in the form of pressure springs 43 which are arranged to influence a supporting member in the direction towards erected position of the table. The springs contribute to raising the table to erected position as well as to holding the table stably in place in this position. In addition to these springs, there may possibly be provided an additional spring (not shown) at each corner of the base member, below the floor element 39, to effect an automatic initial raising of the floor element, and thereby an initial pivotal movement of the supporting columns and the supporting members, when erecting the table, whereafter the springs 43 become active and contribute when erecting the table.

As appears from FIGS. 2–4, the illustrated embodiment presupposes that the rotary shafts and the supporting columns are offset in the direction towards one end edge of the base member 32, so that the opposite end edge of the floor element 39 is not supported by the supporting arms 37, 38 of the rotary shafts. Therefore, an additional supporting means is arranged at said end edge of the floor element. Said means comprises a rod element 44 which, with one end, is rotatably connected to a supporting arm 38 on the central rotary shaft 27, and with its other end is rotatably connected to the free end portion of an additional supporting arm 45 which is attached at one end of an additional rotary shaft 46 at said end edge of the floor element. A corresponding, additional supporting arm 45 is attached at the other end of the rotary shaft 46, and also these supporting arms are provided with rollers 47 with the same function as that of the rollers 42.

The transversely extending rods 24, 25 which are arranged on the underside of the table top, possibly may be displaceable along rails or grooves in the underside of the table top (suggested with dashed lines in FIG. 2), to adjust the table top in a desired position in relation to the supporting columns, when the table is in the erected position.

Figure 5:
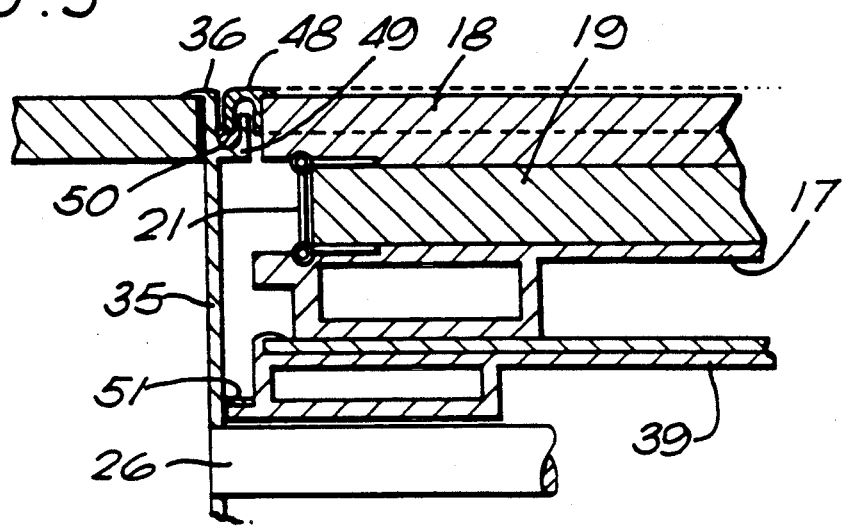
FIGS. 5–7 show fragmentary cross-sectional views, on an enlarged scale, of the table top and the floor element, and show i.a. the sealing connection therebetween and a side wall of the base member.
Figure 6:
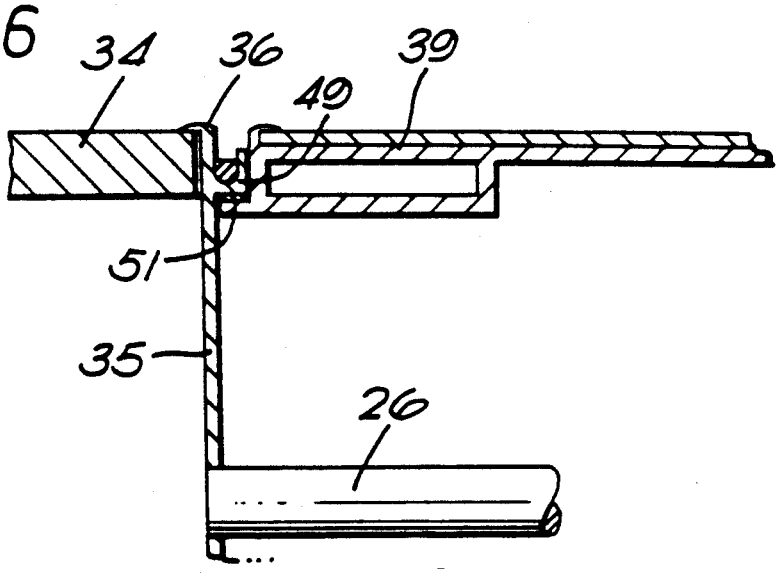
Figure 7:
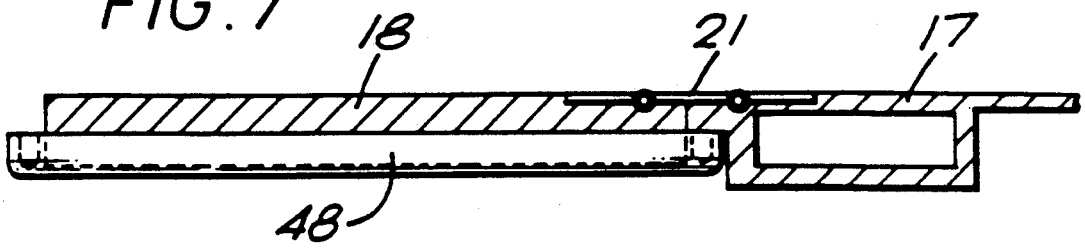

The sealing arrangement between the side walls of the base member and the table top is shown in more detail in FIGS. 5–7. As shown in FIGS. 5 and 7, one flap 18 of the table top, more specifically the flap located uppermost when the table top is folded, is provided with an encircling sealing profile 48. The side walls 35 of the base member in turn are provided with an inwards directed projection 49 having an upwards open groove in which an encircling gasket 50 is provided. When the table top is folded and lowered into the base member, the sealing profile 48 is in engagement with the gasket 50 and provides the intended sealing.

As shown in FIG. 6, there is also provided a corresponding sealing between the floor element 39 and the side walls of the base member when the table is in the erected position and the floor element is raised to the level of the surface of the floor 34. This sealing is obtained in that a gasket 51, which is placed around the periphery of the floor element, rests against the underside of the inwards directed projection 49 of the side walls.

A second embodiment of a table according to the invention is schematically shown in FIGS. 8–11. In this embodiment the raising/lowering mechanism is based on a scissors principle wherein the supporting columns cross each other at a pivot point and form a scissors connection between the table top and the base member. This embodiment results in a reduced space demand in relation to the embodiment according to FIGS. 2–4, and also in reduced manufacturing costs.

The table top 53 of the table 52 consists of a centre member 54 and a pair of flaps 55, 56 which are hinged to each other in a manner corresponding to that of the embodiment according to FIGS. 2–4. The base member also here consists of a box-like member 57 of a design corresponding to that of the previously described embodiment, but which is somewhat different with respect to internal details, for adaptation to the scissors leg variant. The sealing arrangement between the side walls of the base member and the table top and the floor element may correspond to the previously described arrangement, and is therefore not further illustrated and described.

The scissors legs of the table in principle consist of a pair of supporting columns 58, 59 of which one is shown to be bipartite, said column consisting of a pair of rods 59*a*, 59*b* extending one on either side of the other supporting columns, for stabilization of the structure. Each of the supporting columns at one end is rigidly connected to a transversely extending rod 60 and 61, respectively, which is pivotally mounted on the underside of the table top 53. At its other or lower end each of the supporting columns is connected to a transversely extending shaft 62 and 63, respectively, through a lateral part 64 and 65 (65*a*, 65*b*), respectively, extending at a suitable angle with the longitudinal axis of the columns.

As appears from FIGS. 8–11, the shaft 62 for one supporting columns 58 is displaceably mounted in the base member 57, and the transversely extending rod 60 in the pivot connection between the other supporting column 59 and the table top 53 is displaceable in a corresponding manner, in order to allow folding and erection of the table. The transversely extending rod 60 thus is displaceable in suitable guides or grooves 66, 67 (suggested with dashed lines in FIG. 8) in the centre member 54 of the table top, whereas the shaft 62 is displaceable in suitable guides or grooves 68, 69 (also only suggested with dashed lines) in connection with the side walls of the base member 57.

As in the embodiment according to FIGS. 2–4, a supporting member 70 and 71, respectively, is provided on each of the shafts 62, 63, on either side of the supporting columns, which member projects from the shaft and has in principle the same function as in the first embodiment, viz. to support a plate-shaped floor element 72 covering the recess or opening arranged for the base member in the floor where the table is installed. Also in this embodiment each of the supporting members 70 and 71, respectively, is provided with a roller 73, e.g. of rubber, for rolling support of the floor element 72 during raising and lowering thereof. For each supporting column 58 and 59, respectively, the floor element is provided with a longitudinally extending slot 74 and 75 (75*a*, 75*b*), respectively, through which the column extends, for corresponding purposes as in the first embodiment.

In the embodiment according to FIGS. 8–11 the supporting members have another construction than in the first embodiment. More specifically, the supporting members are rotatably mounted on the respective shafts and are influenced by a spring means causing rotation of the supporting members, so that the floor element is raised to the floor surface level also when the table top is raised only to an intermediate position, e.g. to the position shown in FIG. 10, wherein the table then must be able to be locked.

Such a variant is particularly intended for camping cars or leisure-time boats in a sofa corner having a U-shaped sofa. The intermediate position may be of interest in connection with the making-ready of traditional berths, or in the cockpit of a leisure-time boat wherein the table is to function as a support for a sun bed or the like.

The supporting member structure is shown in more detail in FIGS. 12 and 13. Each supporting member 71 here is pivotally mounted on the shaft 63 and is under the preload of a coil spring 76 placed on the shaft. The supporting member 71 is shown in completely erected position in FIG. 12A. As shown, the centre of rotation of the roller 73 in this position is located in an over-centre position in relation to the centre of the shaft 63, so that the supporting member, with the shown shape of its supporting surface, is supported in stable equilibrium with a downwards directed load on the supporting member via the roller 73 and the floor element 72. When lowering &he table to the collapsed position a suitable lug 77 on the lateral part of the supporting column in question causes the supporting member, after lowering of the table below said intermediate position, to be carried to an unstable position of equilibrium (FIG. 12B) with respect to a downwards directed load, so that the supporting members 70, 71 are turned down to the position shown in FIG. 11 when the folded table top 53 is brought to the collapsed position in the base member 57. Instead of arranging said lug 77 on the lateral part of the supporting column, it may possibly be arranged on the associated supporting member 70 and 71, respectively, so that—in a suitable position—it may be influenced by the lateral part of the supporting column in question. For example, the lug may be constituted by an inwards projecting extension of the shaft for mounting of the roller 73 of the supporting member.

Since the supporting members 70, 71 are rotatably arranged on the shafts 62, 63, the shafts in such an embodiment need not be rotatable, but may be non-rotatably mounted in the base member.

A spring means 78 is mounted in the base member in order to influence the displaceable shaft 62 in the direction towards the erected position of the table.

The table according to the invention may be arranged for manual erecting and folding (collapsing), or to be operated by means of suitable mechanical or electrical means. For example, in the embodiment according to FIGS. 2–4, the rotary shaft for one supporting column may be coupled to the drive shaft of a reversible motor (not shown) and can be stopped in the correct positions by means of suitable limit switches.

As suggested in the drawings, the table top 16 and 53, respectively, is provided with only schematically suggested blocking means 79 providing for automatic blocking of the rotary connection between the table top and one of the supporting columns when the table is moved to the erected position, and thereby providing for holding the table blocked in its service position.

Such a blocking means may, e.g., consist of a spring-actuated handle for the operation of a blocking pin which, in blocked condition, is in engagement in a suitable hole in the rotatably mounted transverse rod of the supporting column. In the embodiment according to FIGS. 8-11 the transverse rod will be provided with two blocking holes, for locking of the table in completely raised position as well as in the intermediate position.

In practice locking bolts or the like (not shown) will be provided on one or both sides of the table, for keeping the table in place in collapsed position. These may for example be released by a handle.

The table according to the invention in the illustrated embodiments is shown to have a pair of supporting columns which are connected to their shafts in a central area thereof. In this manner disturbing table legs are avoided at the side edges of the table, something which is advantageous from space considerations, and especially when pivotable chairs are to be pivoted inwards towards and partly under the erected table. In the first-mentioned embodiment the supporting columns and the rotary shafts with associated supporting arms advantageously may be manufactured in one piece from a lightweight metal, for achieving a construction which is as strong and stable as possible. In practice the columns will be detachably connected to the upper transverse rods, for practical and easy assembly and disassembly of the table with the associated floor element. As regards the centre member and the flaps of the table top, and also the floor element in the base member, these may be extruded lightweight metal parts, for example with a cross-section as shown in FIG. 5 for the centre member and the floor element.

I claim:

1. A collapsible table comprising a table top (16; 53), a base member (32; 57) and a number of supporting legs (22, 23; 58, 59) which at one end are pivotally connected to the table top and at the other end are pivotally connected to the base member, the table (15; 52) being arranged for assembly in an opening (33) in the floor (34) at the place of use of the table, and to be placed in a collapsed position wherein the table top (16; 53) forms part of the floor surface, CHARACTERIZED IN that the base member (32; 57) is an upwards open, essentially box-like member which is arranged for assembly in said floor opening (33), the lower ends of the legs (22, 23; 58, 59) being mounted at a bottom portion of the base member (32; 57) and the base member having side walls (35; 80) of such a height that the table top (16; 53) in said collapsed position is flush with the floor surface, and that supporting members (37, 38; 70, 71) are provided in connection with the lower ends of the legs (22, 23; 58, 59), which members are arranged to support a plate-shaped floor element (39; 72) for covering said floor opening (33), so that the floor element in said collapsed position of the table (15; 52) is located between the legs (22, 23; 58, 59) and the supporting members (37, 38; 70, 71), and in the erected position of the table is raised to the level of the floor surface by means of the supporting members.

2. A table according to claim 1, CHARACTERIZED IN that the lower ends of the legs (22, 23; 58, 59) are mounted by means of transversely extending shafts (26, 27; 62, 63) and are connected to the shafts through lateral parts (28, 29; 64, 65), and that said supporting members (37, 38; 70, 71) are mounted on respective ones of said shafts (26, 27; 62, 63).

3. A table according to claim 1 or 2, CHARACTERIZED IN that the side walls (35; 80) of the base member (32; 57) at its upper edge are arranged to form a sealing connection with the side edges of the table top (16; 53) when the table (15; 52) is in the collapsed position.

4. A table according to claim 3, CHARACTERIZED IN that the table top (16; 53) consists of a centre member (17; 54) and side flaps (18, 19; 55, 56) hinged thereto, which flaps can be turned in over the centre member and is shaped in such a manner that the table top in folded condition can be lowered into the box-shaped base member (35; 57) and form said sealing connection.

5. A table according to claim 2, characterized in that the legs consist of a pair of supporting columns (22, 23; 58, 59) which are connected to the respective shaft (26, 27; 62, 63) in a region close to the longitudinal centre line of the table (15; 52), and that the floor element (39; 72) is provided with longitudinally extending slots (40, 41; 74, 75) allowing passage of the supporting columns and the lateral parts (28, 29; 64, 65) thereof during erecting and collapsing of the table.

6. A table according to claim 5, CHARACTERIZED IN that the supporting columns (22, 23) and their lateral parts (28, 29) form substantially L-shaped elements, the supporting columns (22, 23) being vertical in the erected position of the table (15), and the lateral parts in this position resting against a bottom portion of the base member (32).

7. A table according to claim 5, CHARACTERIZED IN that the supporting columns (58, 59) cross each other and form a scissors connection between the table top (53) and the base member (57), the shaft (62) for one supporting column (58) being displaceably mounted in the base member (57) and the rotary connection (60) between the other supporting column (59) and the table top (53) being displaceable in a corresponding manner, to allow collapsing and erecting of the table (52).

8. A table according to claims 2, 5 or 6, characterized in that a supporting member (37, 38; 70, 71) is provided at each end of the respective shaft (26, 27; 62, 63).

9. A table according to claim 5, CHARACTERIZED IN that there is provided at least one spring means (43) which, when erecting the table (15), is arranged to influence a supporting member (37) in the direction towards erected position of the table.

10. A table according to claim 7, CHARACTERIZED IN that the supporting members (70, 71) are rotatably mounted on the shafts (62, 63) and are influenced by a spring means (76) causing rotation of the supporting members, so that the floor element (72) is raised to said floor surface level also when the table top (53) is raised only to an intermediate position.

* * * * *